US011753785B2

(12) United States Patent
Yamazaki

(10) Patent No.: US 11,753,785 B2
(45) Date of Patent: Sep. 12, 2023

(54) SNOW PLOUGH

(71) Applicant: HONDA MOTOR CO., LTD., Tokyo (JP)

(72) Inventor: Nobuo Yamazaki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 364 days.

(21) Appl. No.: 17/255,380

(22) PCT Filed: Jul. 2, 2018

(86) PCT No.: PCT/JP2018/025047
§ 371 (c)(1),
(2) Date: Dec. 22, 2020

(87) PCT Pub. No.: WO2020/008493
PCT Pub. Date: Jan. 9, 2020

(65) Prior Publication Data

US 2021/0301487 A1 Sep. 30, 2021

(51) Int. Cl.
*E01H 5/09* (2006.01)

(52) U.S. Cl.
CPC ..... *E01H 5/098* (2013.01)

(58) Field of Classification Search
CPC ..... E01H 5/098; E01H 5/09; E01H 5/045; E01H 5/04; E01H 5/07; E01H 5/076; E01H 5/08

(Continued)

(56) References Cited

U.S. PATENT DOCUMENTS 6,327,798 B1 * 12/2001 Sakai ..... E01H 5/04 37/249
7,121,021 B2 * 10/2006 Sakai ..... E01H 5/045 37/259

(Continued)

FOREIGN PATENT DOCUMENTS

JP H11-256537 9/1999
WO 2010/095234 8/2010
WO WO-2010095234 A1 * 8/2010 ..... E01H 5/045

OTHER PUBLICATIONS

International Preliminary Report on Patentability dated Jan. 14, 2021, 7 pages.

(Continued)

*Primary Examiner* — Thomas B Will
*Assistant Examiner* — Audrey L Lusk
(74) *Attorney, Agent, or Firm* — Rankin, Hill & Clark LLP

(57) ABSTRACT

A snow plough includes a driving source, an auger housing, a rotating shaft to be driven and rotated by the driving source within the auger housing, and an auger arranged within the auger housing and to be driven and rotated via the rotating shaft. The auger includes a snow-collecting blade located at least on one side in a width direction of the auger, the snow-collecting blade collecting snow toward a center of the auger in the width direction, and a snow-throwing blade located at the center of the auger in the width direction, the snow-throwing unit casting snow collected by the snow-collecting blade by a centrifugal force and discharging snow to an outside via a chute. The snow-throwing blade includes an outer circumferential snow-throwing plate rotating along an outer circumferential region positioned outside an inner circumferential region, the inner circumferential region being a non-snow-throwing region within the auger housing.

4 Claims, 7 Drawing Sheets

(58) Field of Classification Search
USPC ..... 37/259
See application file for complete search history.

(56) References Cited

U.S. PATENT DOCUMENTS

| | | | | |
|---|---|---|---|---|
| 2009/0173600 | A1* | 7/2009 | Niederer | E01H 5/045 198/642 |
| 2014/0237864 | A1* | 8/2014 | Gilpatrick | E01H 5/045 37/259 |

OTHER PUBLICATIONS

International Search Report, dated Sep. 18, 2018, 1 page.
Written Opinion of the International Searching Authority dated Sep. 18, 2018 filed in PCT/JP2018/025047, 4 pages.

* cited by examiner

SNOW PLOUGH

TECHNICAL FIELD

The present invention relates to a snow plough and particularly to a so-called single-stage snow plough that removes snow by driving a snow-collecting unit and a snow-throwing unit by one rotating shaft.

BACKGROUND ART

In related art, for example, a technique has been disclosed in which an auger paddle 28 is housed and disposed in an auger housing 10, the auger paddle 28 includes helical units 28*b* and 28*b* on both sides in an axial direction and a snow-throwing unit 28*c* in a central portion, the auger paddle 28 is driven and rotated by an engine 3, and snow is thereby raked and collected by the helical units 28*b* and 28*b*, is collected together to the snow-throwing unit 28*c* in the central portion, and is discharged from a snow-throwing opening 12 via a chuter 29 by a rotational centrifugal force, in a direction of arrows, of the snow-throwing unit 28*c* in the central portion (for example, see Patent Literature 1).

CITATION LIST

Patent Literature

Patent Literature 1
Japanese Patent Laid-Open No. 11-256537

SUMMARY OF INVENTION

Technical Problem

However, in a technique of the Cited Literature 1, a rotating snow-throwing unit scoops snow, and this snow is discharged by a centrifugal force of the snow-throwing unit; however the snow-throwing unit of an auger is configured with a large surface, and a large amount of snow is scooped by the snow-throwing unit.

Thus, because a sufficient centrifugal force is not given to the snow entering the vicinity of a rotation center of the snow-throwing unit, even if the snow may be discharged, the snow may not be casted to a far area but falls onto a close area. As described above, because the snow falling onto the close area has to be again discharged, efficient snow removal may not be achieved.

An object of the present invention, which has been made in consideration of the above-described point, is to provide a snow plough that may efficiently discharge snow scooped by a snow-throwing unit to a far area and may achieve efficient snow removal.

Solution to Problem

To achieve the above object, an aspect of the present invention provides a snow plough including: a driving source; an auger housing; a rotating shaft to be driven and rotated by the driving source within the auger housing; and an auger arranged within the auger housing and to be driven and rotated via the rotating shaft, in which the auger includes: a snow-collecting unit located at least on one side in a width direction of the auger, the snow-collecting unit collecting snow toward a center of the auger in the width direction; and a snow-throwing unit located at the center of the auger in the width direction, the snow-throwing unit casting snow collected by the snow-collecting unit by a centrifugal force and discharging snow to an outside via a chuter, and in which the snow-throwing unit includes an outer circumferential snow-throwing unit to be rotated along an outer circumferential region positioned outside an inner circumferential region, the inner circumferential region being a non-snow-throwing region within the auger housing.

Accordingly, because snow is casted only by the outer circumferential snow-throwing unit with a large centrifugal force, it is possible to prevent a snow-throwing distance from being decreased due to casting snow by an inner circumferential region with a small centrifugal force and prevent snow from scattering. Accordingly, scooped snow may efficiently be discharged to a far area, and efficient snow removal may thereby be achieved.

In the above configuration, the snow-throwing unit further includes an inner circumferential rotating unit to be rotated along the inner circumferential region being the non-snow-throwing region within the auger housing.

Accordingly, because the inner circumferential rotating unit positioned on an inner circumferential side is provided, the snow in the inner circumferential region may be pushed out toward an outer circumferential side, and the snow may efficiently be moved toward the outer circumferential side. Furthermore, snow may be stirred by producing an air flow within the auger housing by the inner circumferential rotating unit, non-uniformity of snow may be prevented from being formed, and work efficiency may be improved.

In the above configuration, the outer circumferential snow-throwing unit and the inner circumferential rotating unit are arranged spaced from each other, and a path is formed between the outer circumferential snow-throwing unit and the inner circumferential rotating unit.

Accordingly, because the path is formed between the outer circumferential snow-throwing unit and the inner circumferential rotating unit, the snow pushed out by the inner circumferential rotating unit moves toward the outer circumferential snow-throwing unit side through the path, and snow may thus efficiently be moved to the outer circumferential region.

In the above configuration, the outer circumferential snow-throwing unit and the inner circumferential rotating unit are arranged spaced from each other along a circumferential direction of the rotating shaft.

Accordingly, because the outer circumferential snow-throwing unit and the inner circumferential rotating unit are arranged spaced from each other along the circumferential direction, the path is formed between them, and this path enables snow to be efficiently moved to the outer circumferential region.

In the above configuration, the outer circumferential snow-throwing unit and the inner circumferential rotating unit are arranged spaced from each other along a radial direction of the rotating shaft.

Accordingly, because the outer circumferential snow-throwing unit and the inner circumferential rotating unit are arranged spaced from each other along the radial direction, the path is formed between them, and this path enables snow to be efficiently moved to the outer circumferential region.

In the above configuration, the snow plough further includes a coupling unit coupling the outer circumferential snow-throwing unit and the rotating shaft with each other via the inner circumferential rotating unit within the auger housing.

Accordingly, the outer circumferential snow-throwing unit may be reinforced by the coupling unit.

In the above configuration, the coupling unit includes a central wall portion standing from a center of the outer circumferential snow-throwing unit in a width direction.

Accordingly, the outer circumferential snow-throwing unit may be reinforced by the central wall portion.

In the above configuration, the outer circumferential snow-throwing unit is formed into a general U-shape, the general U-shape having an outer circumferential snow-throwing plate and side wall plates standing from both sides of the outer circumferential snow-throwing plate, and the coupling unit includes a support plate coupling the outer circumferential snow-throwing plate and the rotating shaft together via the side wall plates.

Accordingly, reinforcement may be achieved on both sides of the outer circumferential snow-throwing plate by the support plate.

In the above configuration, the inner circumferential rotating unit includes a recessed portion in a central portion in a width direction.

Accordingly, because the recessed portion is formed at the center of the inner circumferential rotating unit in the width direction, the inner circumferential rotating unit is formed into a shovel shape.

Accordingly, snow may easily be collected to the center in the width direction by the inner circumferential rotating unit, and the snow may thereby efficiently be pushed out from the inner circumferential rotating unit toward the outer circumferential snow-throwing unit side.

Advantageous Effects of Invention

In an aspect of the present invention, because snow is casted only by the outer circumferential snow-throwing unit with a large centrifugal force, it is possible to prevent a snow-throwing distance from being decreased due to casting snow by an inner circumferential region with a small centrifugal force and prevent from snow from scattering. Accordingly, scooped snow may efficiently be discharged to a far area, and efficient snow removal may thereby be achieved.

DESCRIPTION OF EMBODIMENTS

An embodiment of the present invention will hereinafter be described with reference to drawings.

Figure 1:
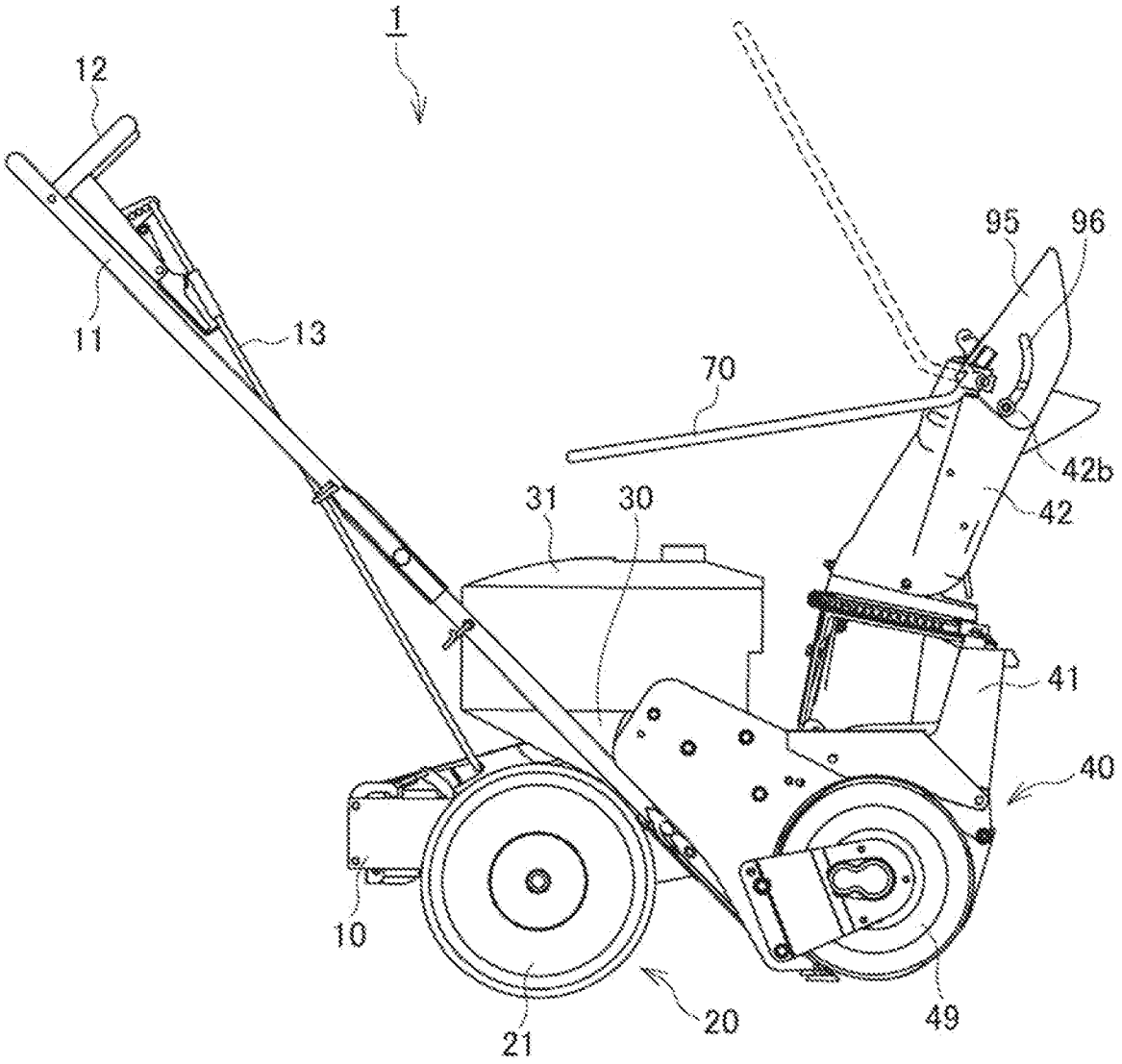
FIG. 1 is a front view illustrating an embodiment of a snow plough of the present invention.
Figure 2:
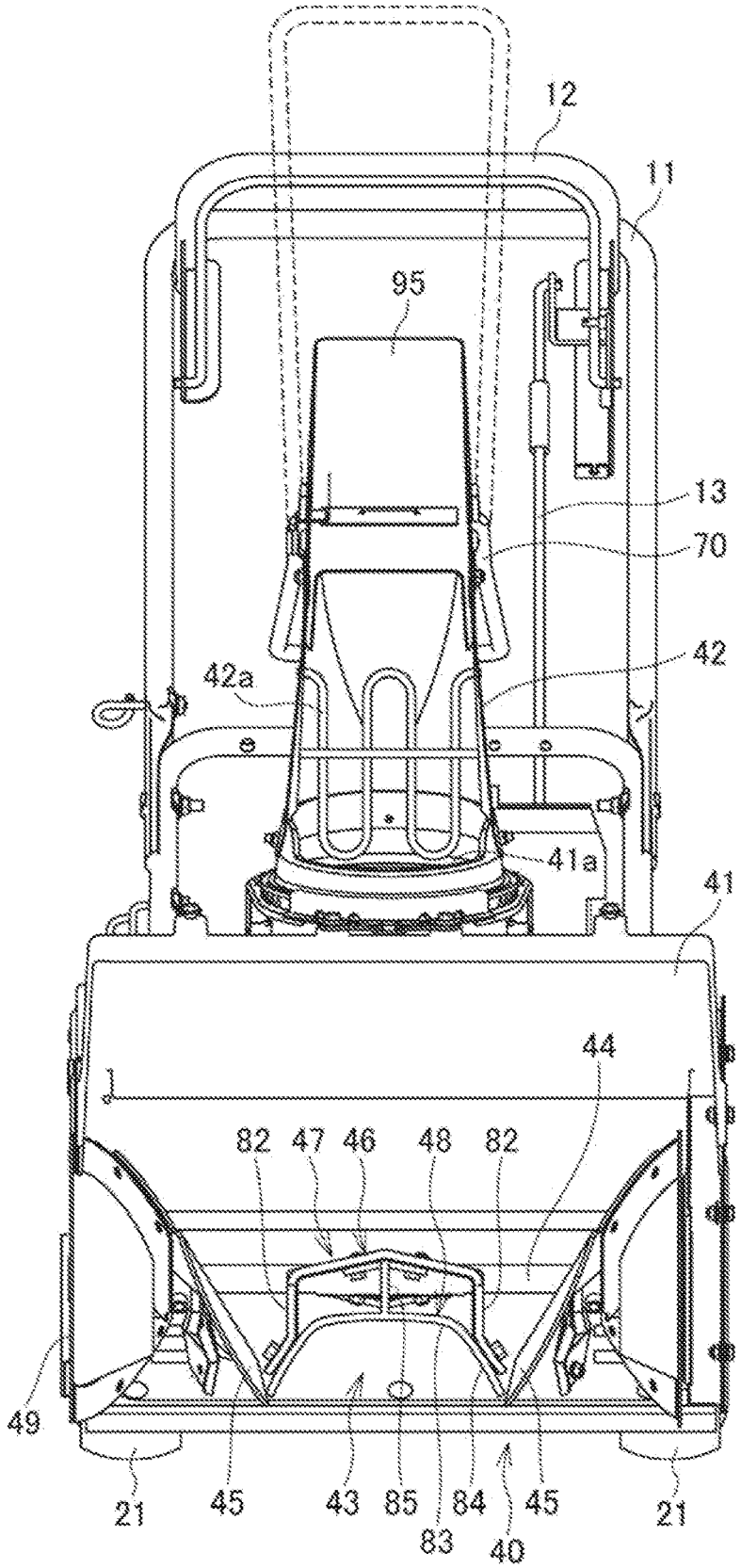
FIG. 2 is a side view illustrating the snow plough of this embodiment.
Figure 3:
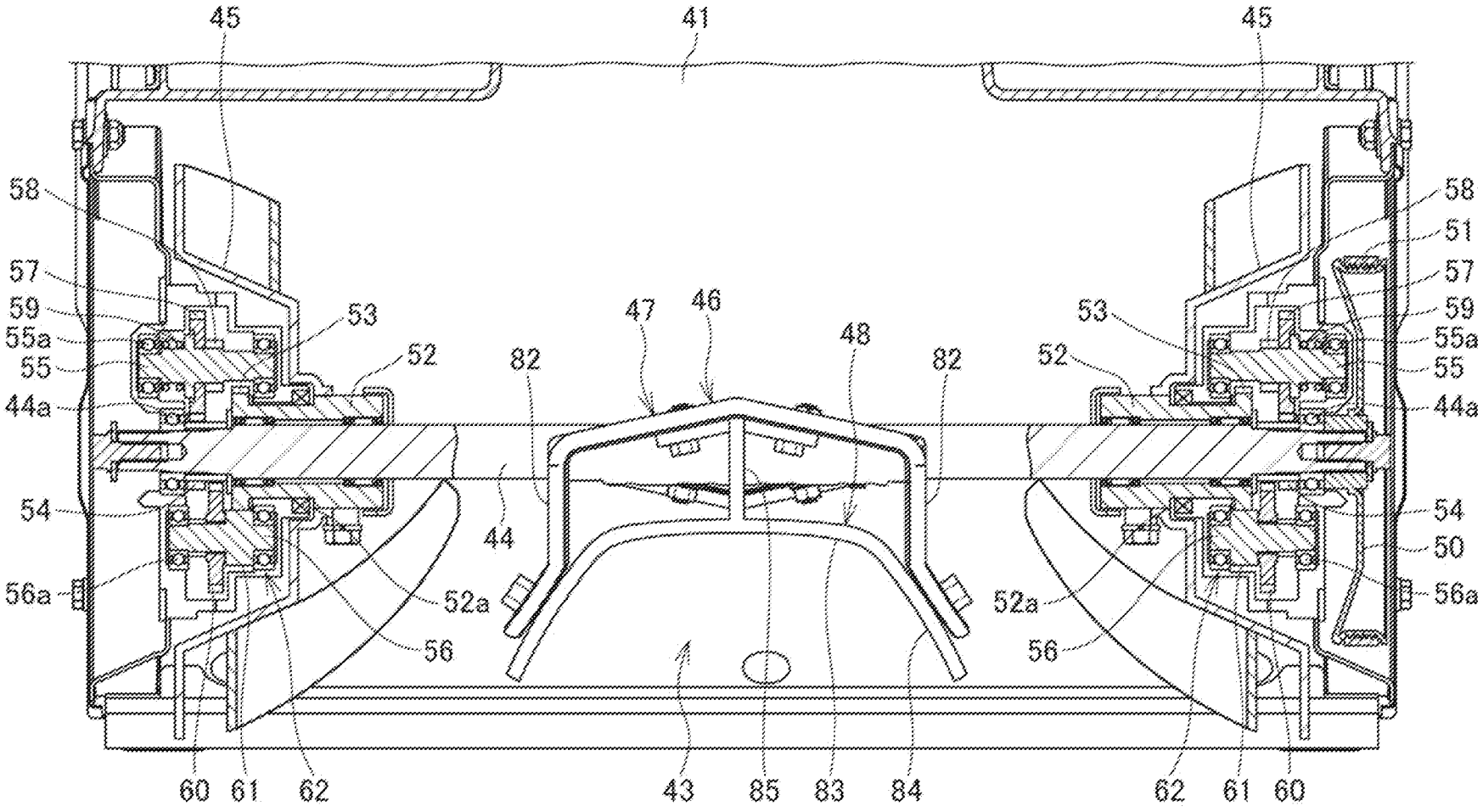
FIG. 3 is a configuration diagram illustrating an auger part of this embodiment.

FIG. 1 is a front view illustrating an embodiment of a snow plough according to the present invention. FIG. 2 is a side view illustrating the snow plough of this embodiment. FIG. 3 is a configuration diagram of an auger part.

As illustrated in FIG. 1 to FIG. 3, a snow plough 1 includes a vehicle body frame 10, and the vehicle body frame 10 includes a traveling device 20, a driving source 30, and a snow removal work unit 40.

In the rear of the vehicle body frame 10, a handle 11 extending toward a rear upper portion is provided. A worker may operate the snow plough 1 by the handle 11 while walking with the snow plough 1.

On a generally central part of the vehicle body frame 10, the driving source 30 including a fuel tank 31 is mounted. This driving source 30 drives the traveling device 20 and the snow removal work unit 40 and is configured with an engine, for example. Note that a gasoline engine is preferable for the driving source 30, but a diesel engine or an electric motor may be used.

The traveling device 20 includes driving wheels 21 arranged in lower rear portions of the vehicle body frame 10. The driving wheels are configured such that motive power from the driving source 30 is transmitted thereto via a motive power transmission mechanism and a clutch mechanism (neither illustrated). Accordingly, in this configuration, the driving source 30 is driven and the driving wheels 21 are thereby driven to move forward or driven to move rearward via the motive power transmission mechanism and the clutch mechanism.

An operation lever 12 is provided to a tip end portion of the handle 11. The operation lever 12 is formed into a general U-shape, and both end portions thereof are attached to insides of the handle 11. The operation lever 12 is attached swingably in a front-rear direction with respect to attachment positions to the handle 11 as centers.

One end of a coupling shaft 13 is coupled with the operation lever 12, the other end of the coupling shaft 13 is connected with a driving wheel part of the vehicle body frame 10, and in this configuration, the driving wheels may be driven or stopped by a swinging operation of the operation lever 12.

In front of the vehicle body frame 10, the snow removal work unit 40 is provided.

The snow removal work unit 40 includes an auger housing 41. The auger housing 41 extends in a width direction of the vehicle body frame 10 and is formed into a tubular shape whose front portion is open. A circular snow-throwing opening 41*a* is formed in an upper portion of the auger housing 41 and in a center of the auger housing in a width direction.

A tubular chuter 42 communicating with the inside of the auger housing 41 is attached to the snow-throwing opening 41*a* of the auger housing while being inclined with respect to the snow-throwing opening 41*a*. The chuter 42 extends upward and is made rotatable along a peripheral portion of the snow-throwing opening 41*a* such that a direction in which the removed snow is discharged may be adjusted. A guide 42*a* meandering in an up-down direction is provided within the chuter 42.

A chute 95 is attached to an upper end portion of the chuter 42 swingably in the up-down direction, the chute 95 being for adjusting an angle at which the removed snow is discharged. Arc-shaped guide holes 96 are formed on both sides of the chute 95, and guide pins 42*b* attached to both sides of the chuter 42 are engaged with the guide holes 96. Accordingly, in this configuration, the guide holes 96 are moved along the guide pins 42*b* and the chute 95 may thereby be swung up and down.

Further, a chuter operation handle 70 is attached to both sides of a lower portion of the chute 95. The chuter operation handle 70 is formed into a general U-shape and is configured such that a rotation operation of the chuter 42 and an up-down swinging operation of the chute 95 may be performed by operating the chuter operation handle 70.

An auger 43 is provided within the auger housing 41. The auger 43 includes a rotating shaft 44 extending in the width direction of the auger housing 41.

The auger 43 includes snow-collecting blades 45, which serves as snow-collecting units, located on both sides of the rotating shaft 44 for collecting snow toward the center of the auger 43 in the width direction, and a snow-throwing blade 46, which serves as a snow-throwing unit, located at a center of the rotating shaft 44 for casting snow collected by the snow-collecting blades 45 by a centrifugal force and discharging snow to the outside via the chuter 42.

The snow-collecting blades 45 are attached to the rotating shaft 44 while being inclined at a prescribed angle with respect to that. The snow-throwing blade 46 is configured with a rotating plate 47 and a snow-throwing plate 48 arranged at a prescribed space on an outer circumferential side of this rotating plate.

Side disk augers 49 are provided on both sides of the auger housing 41.

Note that in this embodiment, the snow-collecting blades 45 are provided on both sides of the rotating shaft 44 in an axial direction but may be provided on only one side of the rotating shaft 44 in a width direction.

Next, the snow-throwing blade will be described.

Figure 4:
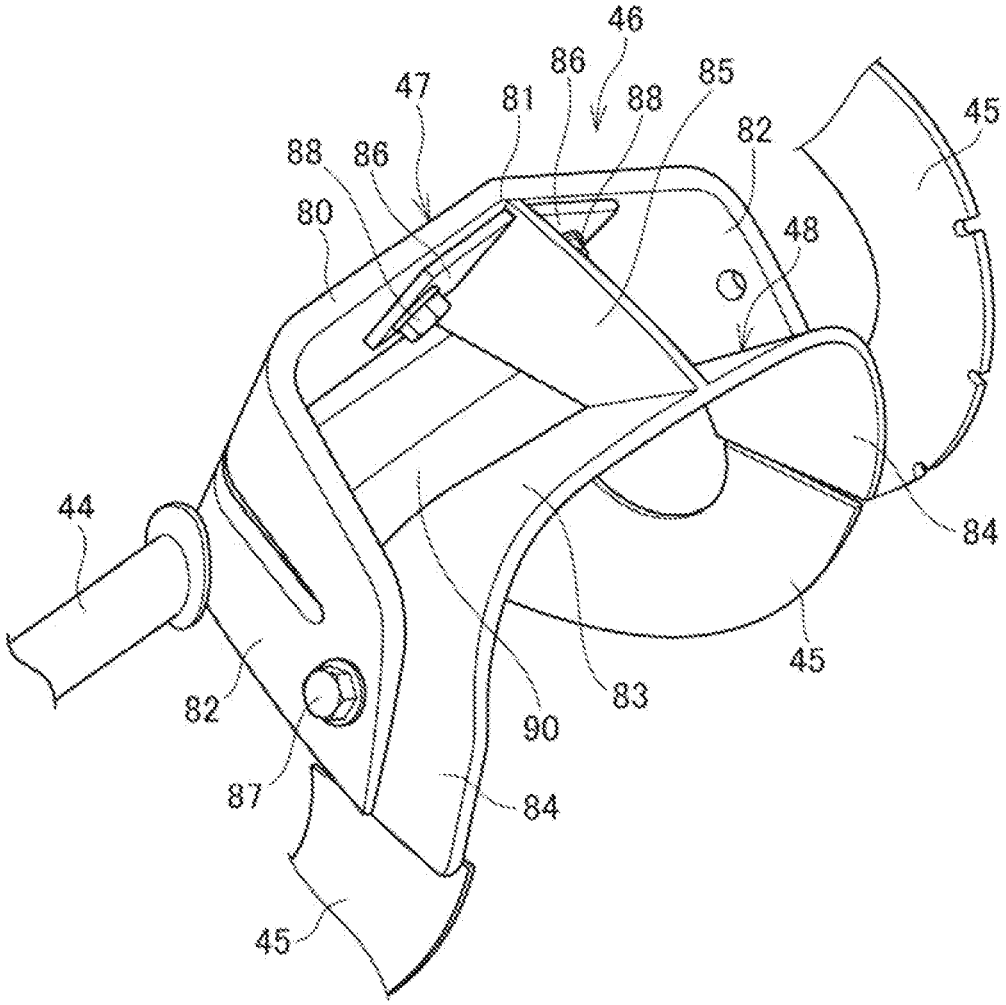
FIG. 4 is an outline perspective view illustrating a snow-throwing blade of this embodiment.
Figure 5:
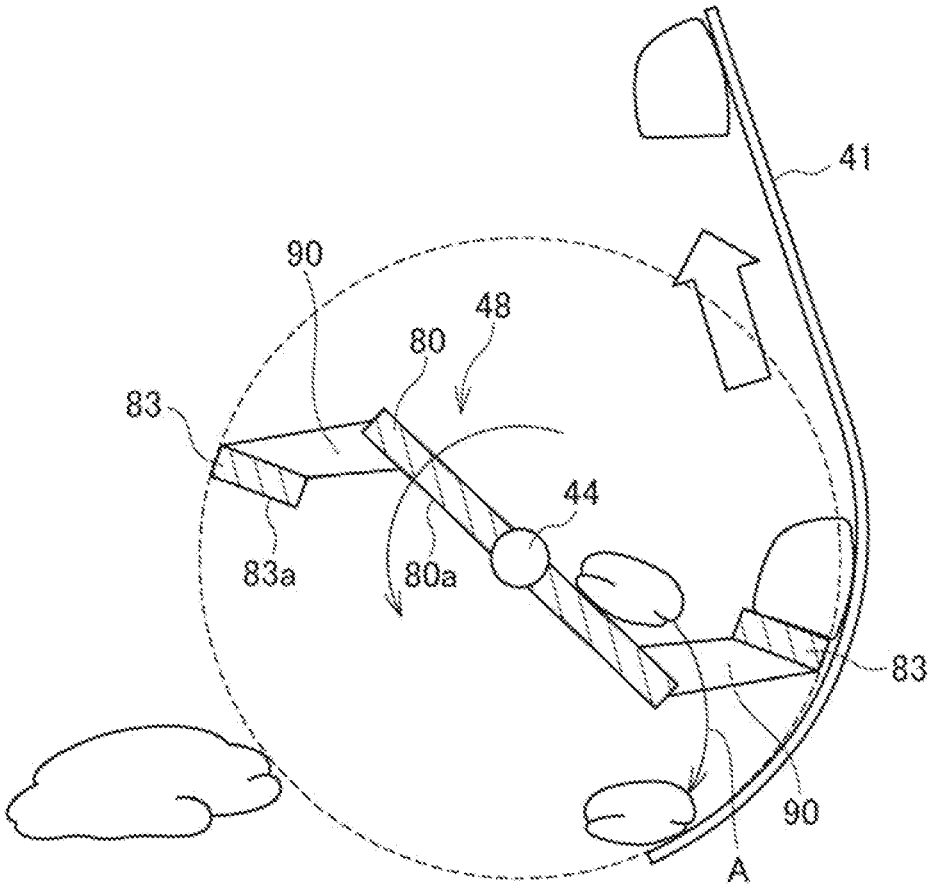
FIG. 5 is an outline cross-sectional view illustrating the snow-throwing blade of this embodiment.

FIG. 4 is an outline perspective view illustrating the snow-throwing blade. FIG. 5 is an outline cross-sectional view illustrating the snow-throwing blade.

As illustrated in FIG. 4, the snow-throwing blade 46 includes the rotating plate 47 attached to the rotating shaft 44 and the snow-throwing plate 48 attached on the outer circumferential side of the rotating plate 47.

The rotating plate 47 includes a plate-shaped inner circumferential rotating plate 80 extending in the axial direction of the rotating shaft 44, and in this embodiment, the inner circumferential rotating plate 80 is rotated along an inner circumferential region as a non-snow-throwing region. The non-snow-throwing region is a region not throwing snow and has a function of moving snow to the snow-throwing plate 48 arranged in an outer circumferential region positioned outside the non-snow-throwing region.

A central part of the inner circumferential rotating plate 80 in the axial direction includes a recessed portion 81 in which the central part is recessed toward one side. Accordingly, the inner circumferential rotating plate 80 is formed into a gentle chevron shape having a central portion as a vertex.

Further, support plates 32 extending in a direction orthogonal to the rotating shaft 44 are integrally provided to both end portions of the inner circumferential rotating plate 80. The snow-throwing plate 48 is attached to tip end portions of the support plates 82 of the rotating plate 47. The support plate 82 functions as a coupling unit mentioned in the present invention.

The snow-throwing plate 48 includes an outer circumferential snow-throwing plate 83 arranged generally in parallel with the inner circumferential rotating plate 80 and side wall plates 84 extending from both sides of the outer circumferential snow-throwing plate 83 and positioned inside the respective support plates 82. The outer circumferential snow-throwing plate 83 and the side wall plates 84 are integrally formed.

The side wall plates 84 extend from both end portions of the outer circumferential snow-throwing plate 83 in a direction generally orthogonal to the rotating shaft 44, and the whole snow-throwing plate 48 is formed into a general U-shape.

Further, a central wall portion 85 abutting the recessed portion 81 of the inner circumferential rotating plate 80 is provided in a generally central portion of the outer circumferential snow-throwing plate 83. Flanges 86 extending in the direction of the rotating shaft 44 are respectively and integrally provided to both sides of a tip end portion of the central wall portion 85. The central wall portion 85 functions as the coupling unit mentioned in the present invention.

Further, in this configuration, that the side wall plates 84 are fixed to the support plates 82 of the rotating plate 47 by bolts 87, the inner circumferential rotating plate 80 and the flanges 86 are fixed together by bolts 88, and the snow-throwing plate 48 is thereby fixed to the rotating plate 47.

In this embodiment, as illustrated in FIG. 5, a surface 80*a* of the inner circumferential rotating plate 80 of the rotating plate 47 and a surface 83*a* of the outer circumferential snow-throwing plate 83 of the snow-throwing plate 48 are configured to be different. That is, the surface 83*a* of the outer circumferential snow-throwing plate 83 is arranged while being inclined at a prescribed angle with respect to the surface 80*a* of the inner circumferential rotating plate 80, and the surface 83*a* of the outer circumferential snow-throwing plate 83 is arranged upstream in a circumferential direction with respect to a rotating direction of the rotating plate 47.

In such a configuration, a path 90 is formed between the inner circumferential rotating plate 80 of the rotating plate 47 and the outer circumferential snow-throwing plate 83 of the snow-throwing plate 48.

Accordingly, in a case where snow removal is performed by rotating and driving the snow-throwing blade 46, the outer circumferential snow-throwing plate 83 contacts with snow due to rotation of the rotating plate 47, and the outer circumferential snow-throwing plate 83 scoops snow and throws that upward. Further, as indicated by an arrow A in FIG. 5, the snow entering the inner circumferential rotating plate 80 of the rotating plate 47 is moved toward an outer circumferential side via the path 90, and this snow moved toward the outer circumferential side is thrown upward by the outer circumferential snow-throwing plate 83 next coming there by rotation.

Figure 6:
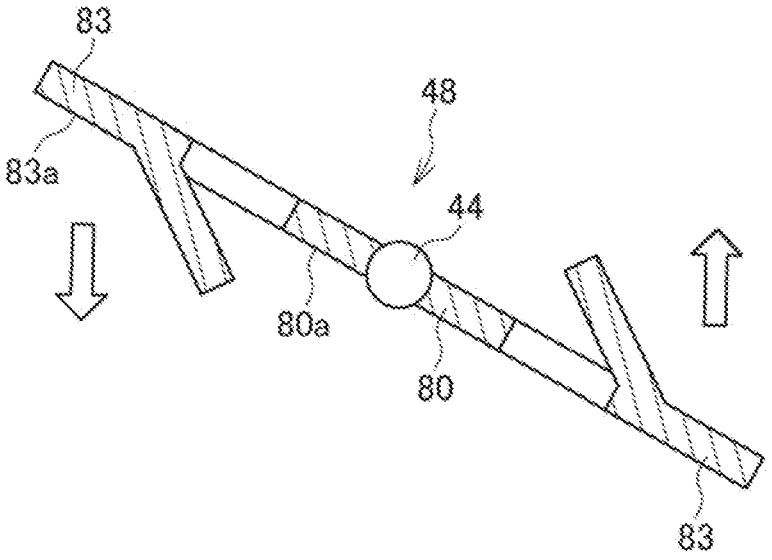
FIG. 6 is an outline diagram illustrating a modification example of the snow-throwing blade of this embodiment.
Figure 7:
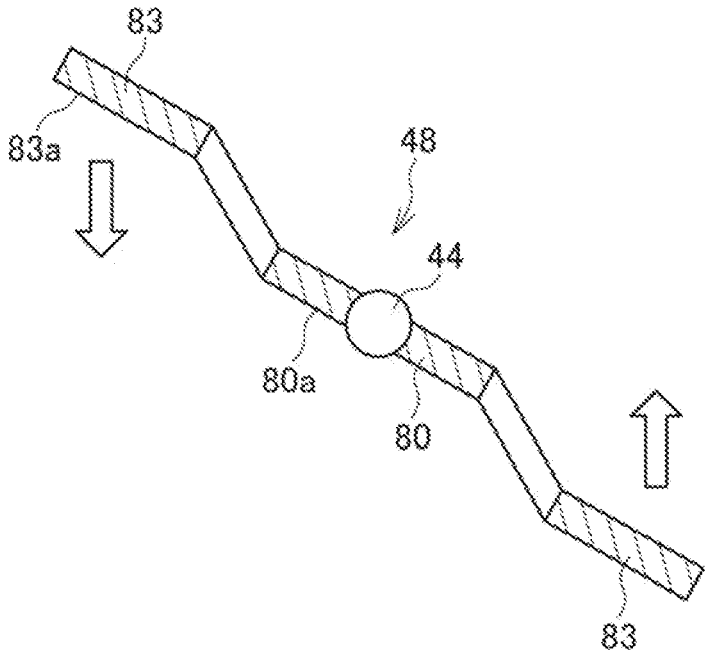
FIG. 7 is an outline diagram illustrating a modification example of the snow-throwing blade of this embodiment.

FIG. 6 and FIG. 7 are outline diagrams illustrating modification examples of the snow-throwing blade 46.

In the snow-throwing blade 46 illustrated in FIG. 6, the surface 83*a* of the outer circumferential snow-throwing plate 83 is arranged on generally the same plane with respect to the surface 80*a* of the inner circumferential rotating plate 80.

Further, in the snow-throwing blade 46 illustrated in FIG. 7, the surface 83*a* of the outer circumferential snow-throwing plate 83 is arranged generally in parallel with the surface 80*a* of the inner circumferential rotating plate 80, and the surface 83*a* of the outer circumferential snow-throwing plate 83 is arranged downstream in the circumferential direction with respect to the rotating direction of the rotating plate 47.

Both configurations of the snow-throwing blade 46 illustrated in FIG. 6 and FIG. 7 may preferably be applied.

Next, a motive power transmission mechanism in the snow removal work unit 40 will be described.

As illustrated in FIG. 3, the rotating shaft 44 is rotatably supported by bearings 44*a* in both end portions of the auger housing.

A driving pulley 50 is attached to one end portion of the rotating shaft 44. A driving belt 51 rotated by the driving source 30 is wound around the driving pulley 50. Further, the driving pulley 50 is driven and rotated via the driving belt 51 by driving the driving source 30, and the rotating shaft 44 may thereby be driven and rotated.

On an outer circumferential side of the rotating shaft 44, a snow-collecting rotating shaft 52 is rotatably supported by a bearing 52*a*. The snow-collecting rotating shaft 52 is coaxially arranged with the rotating shaft 44 and is made rotatable separately from the rotating shaft 44. The snow-collecting blade 45 is attached to an outer circumference of the snow-collecting rotating shaft 52. A snow-collecting driving gear 53 is provided to an outer circumference of one end portion of the snow-collecting rotating shaft 52.

Further, in this embodiment, the snow-collecting blades 45 are attached such that their rotating phases are different. Specifically, the snow-collecting blades 45 are attached such that their phases are shifted at 90° with respect to the rotating direction.

Further, a first gear 54 is attached to the end portion of the rotating shaft 44. On the outer circumferential side of the rotating shaft 44, a second rotating shaft 55 and a third rotating shaft 56 are rotatably supported by bearings 55*a* and 56*a*, respectively, the second rotating shaft 55 and the third rotating shaft 56 extending in parallel with the rotating shaft 44.

To an outer circumference of the second rotating shaft 55, a second driven gear 57 meshing with the first gear 54 and a second driving gear 58 are provided. The second driven gear 57 meshes with the first gear 54. A first speed reduction mechanism 59 is configured with those second rotating shaft 55, second driven gear 57, and second driving gear 58.

To an outer circumference of the third rotating shaft 56, a third driven gear 60 meshing with the second driving gear 58 and a third driving gear 61 are provided. The third driven gear 60 meshes with the second driving gear 58. A second speed reduction mechanism 62 is configured with those third rotating shaft 56, third driven gear 60, and third driving gear 61.

Further, the third driving gear 61 of the third rotating shaft 56 meshes with the snow-collecting driving gear 53 of the snow-collecting rotating shaft 52.

Accordingly, when the driving pulley 50 is driven and rotated via the driving belt 51 by driving the driving source 30, the rotating shaft 44 is driven and rotated. Further, the snow-throwing blade 46 attached to the rotating shaft 44 is driven and rotated by driving and rotation of the rotating shaft 44. In this case, the snow-throwing blade 46 is driven for forward rotation rotating in a direction in which the snow plough 1 moves.

Meanwhile, the snow-collecting rotating shaft 52 is driven and rotated via each of the second driven gear 57 meshing with the first gear 54 of the rotating shaft 44, the third driven gear 60 meshing with the second driving gear 58, and the snow-collecting driving gear 53 meshing with the third driving gear 61. This snow-collecting rotating shaft 52 is driven and rotated with respect to the rotating shaft 44 via the first speed reduction mechanism 59 and the second speed reduction mechanism 62 and is thus rotated in the opposite direction to the rotating direction of the snow-throwing blade 46.

Further, appropriately setting the number of teeth of each of the first gear 54, the second driven gear 57, the second driving gear 58, the third driven gear 60, the third driving gear 61, and the snow-collecting driving gear 53 makes it possible to arbitrarily set the reduction ratio of the snow-collecting driving gear 53 with respect to the rotational frequency of the first gear 54.

Here, in this embodiment, the reduction ratio is set to approximately 1:10, and in this configuration, the rotational speed of the snow-collecting rotating shaft 52 is reduced to approximately 1/10 with respect to the rotational speed of the rotating shaft 44.

Note that as for the above-described motive power transmission mechanism, a description is made about a mechanism driving and rotating the rotating shaft 44 and the right-side snow-collecting blade in FIG. 3; however, a similar motive power transmission mechanism is also provided to the other end portion (left side in FIG. 3) of the rotating shaft 44, and in this configuration, the left-side snow-collecting blade in FIG. 3 is driven and rotated by the motive power transmission mechanism.

Next, an action of this embodiment will be described.

First, when the driving pulley 50 is driven and rotated via the driving belt 51 by driving the driving source 30, the rotating shaft 44 is driven and rotated. Further, the snow-throwing blade 46 attached to the rotating shaft 44 is driven and rotated by driving and rotation of the rotating shaft 44. In this case, the snow-throwing blade 46 is driven for forward rotation rotating in the direction in which the snow plough 1 moves.

Meanwhile, the snow-collecting rotating shaft 52 is driven and rotated in the opposite direction to the rotating shaft 44 in response to driving and rotation of the rotating shaft 44 via each of the second driven gear 57 meshing with the first gear 54 of the rotating shaft 44, the third driven gear 60 meshing with the second driving gear 58, and the snow-collecting driving gear 53 meshing with the third driving gear 61, and the snow-collecting blade 45 is driven and rotated.

As described above, when the snow-collecting blades 45 are driven and rotated by rotating the snow-collecting rotating shafts 52, the snow present within the auger housing 41 is collected to the center by the snow-collecting blades 45, and the snow collected to the center by the snow-collecting blades 45 is discharged to the outside via the chuter 42 by driving and rotation of the snow-throwing blade 46.

In this case, in this embodiment, the snow-throwing blade 46 is configured with the rotating plate 47 and the snow-throwing plate 48, and the path 90 is formed between the rotating plate 47 and the snow-throwing plate 48.

As illustrated in FIG. 5, when the snow collected to the center by the snow-collecting blades is scooped by the snow-throwing blade 46, the snow scooped by the inner circumferential rotating plate 80 of the rotating plate 47 falls downward, that is, toward the outer circumferential side through the path 90. Then, the snow caused to fall is scooped by the outer circumferential snow-throwing plate 83 next coming there by rotation and is discharged to the outside by a centrifugal force of the outer circumferential snow-throwing plate 83.

That is, because snow is thrown by the outer circumferential snow-throwing plate 83 in the snow-throwing blade 46, the outer circumferential snow-throwing plate 83 located on the outer circumferential side, and snow is thus casted only by the outer circumferential snow-throwing plate 83 with a large centrifugal force, it is possible to prevent a snow-throwing distance from being decreased due to casting snow by the inner circumferential region with a small centrifugal force and prevent snow from scattering. Further, the path 90 is formed, and snow may thereby efficiently be moved to the outer circumferential side.

Further, the snow-throwing blade 46 is provided with the rotating plate 47 positioned on an inner circumferential side, may thus push out the snow in the inner circumferential region toward the outer circumferential side, and may efficiently move the snow toward the outer circumferential side. Furthermore, snow may be stirred by producing an air flow within the auger housing by the rotating plate 47, and non-uniformity of snow may be prevented from being formed.

Further, because the recessed portion 81 is formed at a center of the rotating plate 47 in the width direction, the rotating plate 47 is formed into a shovel shape. Accordingly, snow may easily be collected to the center in the width direction by the rotating plate 47, and the snow may thereby efficiently be pushed out from the rotating plate 47 toward the outer circumferential snow-throwing plate 83 side.

As described in the foregoing, in this embodiment, the snow plough 1 includes the driving source 30, the auger housing 41, the rotating shaft 44 to be driven and rotated by the driving source 30 within the auger housing 41, and the auger 43 arranged within the auger housing 41 and to be driven and rotated via the rotating shaft 44. The auger 43 includes the snow-collecting blade 45 (snow-collecting unit) that is located at least on one side in the width direction of the auger 43 and collects snow toward the center of the auger 43 in the width direction and the snow-throwing blade 46 (snow-throwing unit) located at the center of the auger 43 in the width direction, the snow-throwing unit casting snow collected by the snow-collecting blade 45 by a centrifugal force and discharging snow to the outside via the chuter 42. The snow-throwing blade 46 includes the outer circumferential snow-throwing plate 83 (outer circumferential snow-throwing unit) rotating along the outer circumferential region positioned outside the inner circumferential region, the inner circumferential region being the non-snow-throwing region within the auger housing.

Accordingly, because snow is casted only by the outer circumferential snow-throwing plate 83 with a large centrifugal force, it is possible to prevent the snow-throwing distance from being decreased due to casting snow by the inner circumferential region with a small centrifugal force and prevent snow from scattering, and thus the scooped snow may efficiently be discharged to a far area, and efficient snow removal may thereby be achieved.

Further, in this embodiment, the snow-throwing blade 46 (snow-throwing unit) further includes the inner circumferential rotating plate 80 (inner circumferential rotating unit) rotating along the inner circumferential region being the non-snow-throwing region within the auger housing.

Accordingly, because the inner circumferential rotating plate 80 positioned on the inner circumferential side is provided, the snow in the inner circumferential region may be pushed out toward the outer circumferential side, and the snow may efficiently be moved toward the outer circumferential side. Furthermore, snow may be stirred by producing an air flow within the auger housing by the inner circumferential rotating plate 80, non-uniformity of snow may be prevented from being formed, and work efficiency may be improved.

Further, in this embodiment, the outer circumferential snow-throwing plate 83 (outer circumferential snow-throwing unit) and the inner circumferential rotating plate 80 (inner circumferential rotating unit) are arranged spaced from each other, and the path 90 is formed between the outer circumferential snow-throwing plate 83 and the inner circumferential rotating plate 80.

Accordingly, because the path 90 is formed between the outer circumferential snow-throwing plate 83 and the inner circumferential rotating plate 80, the snow pushed out by the inner circumferential rotating plate 80 moves toward the outer circumferential snow-throwing plate 83 side through the path 90, and snow may thus efficiently be moved to the outer circumferential region.

Further, in this embodiment, the outer circumferential snow-throwing plate 83 (outer circumferential snow-throwing unit) and the inner circumferential rotating plate 80 (inner circumferential rotating unit) are arranged spaced from each other along a circumferential direction of the rotating shaft 44.

Accordingly, because the outer circumferential snow-throwing plate 83 and the inner circumferential rotating plate 80 are arranged spaced from each other along the circumferential direction, the path 90 is formed between them, and this path 90 enables snow to be efficiently moved to the outer circumferential region.

Further, in this embodiment, the outer circumferential snow-throwing plate 83 (outer circumferential snow-throwing unit) and the inner circumferential rotating plate 80 (inner circumferential rotating unit) are arranged spaced from each other along a radial direction of the rotating shaft 44.

Accordingly, because the outer circumferential snow-throwing plate 83 and the inner circumferential rotating plate 80 are arranged spaced from each other along the radial direction, the path 90 is formed between them, and this path 90 enables snow to be efficiently moved to the outer circumferential region.

Further, in this embodiment, the snow plough 1 further includes the coupling unit coupling the outer circumferential snow-throwing plate 83 (outer circumferential snow-throwing unit) and the rotating shaft 44 with each other via the inner circumferential rotating plate 80 (inner circumferential rotating unit) within the auger housing.

Accordingly, the outer circumferential snow-throwing plate 83 may be reinforced by the coupling unit.

Further, in this embodiment, the coupling unit includes the central wall portion 85 standing from a center of the outer circumferential snow-throwing plate 83 (outer circumferential snow-throwing unit) in a width direction.

Accordingly, the outer circumferential snow-throwing plate 83 may be reinforced by the central wall portion 85.

Further, in this embodiment, the snow-throwing plate 48 is formed into a general U-shape, the general U-shape having the outer circumferential snow-throwing plate 83 and the side wall plates 84 standing from both sides of the outer circumferential snow-throwing plate 83, and the coupling unit includes the support plates 82 coupling an outer circumferential snow-throwing plate 83 and the rotating shaft 44 together via the side wall plates 84.

Accordingly, reinforcement may be achieved on both sides of the outer circumferential snow-throwing plate 83 by the support plates 82.

Further, in this embodiment, the inner circumferential rotating plate 80 (inner circumferential rotating unit) includes the recessed portion 81 in a central portion in the width direction.

Accordingly, because the recessed portion 81 is formed at the center of the inner circumferential rotating plate 80 in the width direction, the inner circumferential rotating plate 80 is formed into a shovel shape. Accordingly, snow may easily be collected to the center in the width direction by the inner circumferential rotating plate 80, and the snow may thereby efficiently be pushed out from the inner circumferential rotating plate 80 toward the outer circumferential snow-throwing plate 83 side.

Note that the present invention has been described based on the embodiment; however, the present invention is not limited to this embodiment. Because the embodiment merely represents one form for carrying out the present invention as an example, any modifications and applications are possible without departing from the scope of the gist of the present invention.

In the above embodiment, a description is made about a case where two outer circumferential snow-throwing plates 83 are provided in a circumferential direction; however, the present invention is not limited to this. For example, one or three or more outer circumferential snow-throwing plates 83 may be provided in the circumferential direction.

REFERENCE SIGNS LIST

1 snow plough
10 vehicle body frame
11 handle
12 operation lever
13 coupling shaft
20 traveling device
21 driving wheel
30 driving source
40 snow removal work unit
41 auger housing
42 chuter
43 auger
44 rotating shaft
45 snow-collecting blade
46 snow-throwing blade
47 rotating plate
48 snow-throwing plate
52 snow-collecting rotating shaft
80 inner circumferential rotating plate
81 recessed portion
82 support plate
83 outer circumferential snow-throwing plate
84 side wall plate
85 central wall portion
86 flange
90 path
95 chute

The invention claimed is:

1. A snow plough comprising:

a driving source;

an auger housing;

a rotating shaft to be driven and rotated by the driving source within the auger housing; and an auger arranged within the auger housing and to be driven and rotated via the rotating shaft, wherein the auger includes:

a snow-collecting unit located at least on one side in a width direction of the auger, the snow-collecting unit collecting snow toward a center of the auger in the width direction; and a snow-throwing unit located at the center of the auger in the width direction, the snow-throwing unit casting snow collected by the snow-collecting unit by a centrifugal force and discharging snow to an outside via a chute, and wherein the snow-throwing unit includes a rotating plate attached to the rotating shaft and a snow-throwing plate attached on an outer circumferential side of the rotating plate, the rotating plate includes an inner circumferential rotating plate and support plates, the inner circumferential rotating plate is plate-shaped and extends in an axial direction of the rotating shaft, the support plates extend in a direction generally orthogonal to the rotating shaft from both end portions in an extending direction of the inner circumferential rotating plate, the snow-throwing plate is attached to tip end portions of the support plates, the snow-throwing plate includes an outer circumferential snow-throwing plate and side wall plates, the outer circumferential snow-throwing plate is plate-shaped and extends in the axial direction of the rotating shaft and is spaced from the inner circumferential rotating plate, the side wall plates extend in the direction generally orthogonal to the rotating shaft from both end portions in the extending direction of the outer circumferential snow-throwing plate and are positioned inside each of the support plates, a plate surface of the outer circumferential snow-throwing plate is inclined at a prescribed angle with respect to a plate surface of the inner circumferential rotating plate, and the inner circumferential rotating plate rotates along inner circumferential region positioned inside an outer circumferential region, the inner circumferential region being a non-snow-throwing region within the auger housing, and the outer circumferential snow-throwing plate rotates along the outer circumferential region positioned outside the non-snow-throwing region.

2. The snow plough according to claim 1, further comprising a coupling unit coupling the snow-throwing plate and the rotating shaft with each other via the rotating plate.

3. The snow plough according to claim 2, wherein the coupling unit includes a central wall portion standing from a center of the snow-throwing plate in a width direction.

4. The snow plough according to claim 1, wherein the inner circumferential rotating plate includes a recessed portion in a central portion in a width direction.

* * * * *